United States Patent [19]

Matsumura

[11] Patent Number: 4,551,977

[45] Date of Patent: Nov. 12, 1985

[54] TURBOCHARGED INTERNAL COMBUSTION ENGINE

[75] Inventor: Motohiro Matsumura, Funabashi, Japan

[73] Assignee: Nissan Motor Co., Ltd., Japan

[21] Appl. No.: 544,637

[22] Filed: Oct. 24, 1983

[30] Foreign Application Priority Data

Oct. 26, 1982 [JP] Japan ..... 57-187790

[51] Int. Cl.[4] ..... F02B 37/00

[52] U.S. Cl. ..... 60/611

[58] Field of Search ..... 60/611, 600, 601; 123/559, 564

[56] References Cited

U.S. PATENT DOCUMENTS

| | | | |
|---|---|---|---|
| 3,366,314 | 1/1968 | Schröder | 417/68 |
| 3,957,399 | 5/1976 | Siczek | 417/387 |
| 4,147,478 | 4/1979 | Vork | 417/503 |
| 4,449,371 | 5/1984 | Sone et al. | 60/611 |

FOREIGN PATENT DOCUMENTS

| | | | |
|---|---|---|---|
| 57-52651 | 3/1982 | Japan | 60/611 |
| 57-129222 | 8/1982 | Japan | 60/611 |
| 245136 | 5/1926 | United Kingdom . | |
| 250565 | 6/1927 | United Kingdom . | |
| 363325 | 12/1932 | United Kingdom . | |
| 1050188 | 12/1966 | United Kingdom . | |
| 1563003 | 3/1980 | United Kingdom . | |
| 2002058 | 1/1982 | United Kingdom . | |

*Primary Examiner*—Michael Koczo
*Assistant Examiner*—John J. McGlew, Jr.
*Attorney, Agent, or Firm*—Leydig, Voit & Mayer

[57] ABSTRACT

A turbocharged internal combustion engine comprises an intake air passageway in which a throttle valve is pivotally disposed. A turbocharger compressor wheel is disposed in the intake air passageway upstream of the throttle valve. An intake air bypass passageway is connected to the intake air passageway bypassing the throttle valve and provided with an air regulator. Additionally, a check valve is disposed in the bypass passageway downstream of the air regulator to prevent intake air from its reverse flow in a direction from the intake air passageway downstream of the throttle valve toward the air regulator, thereby avoiding lowering in supercharging efficiency of the turbocharger.

5 Claims, 3 Drawing Figures

TURBOCHARGED INTERNAL COMBUSTION ENGINE

BACKGROUND OF THE INVENTION

1. Field of the Invention

This invention relates in general to a turbocharged internal combustion engine, and more particularly to an improvement in an air regulator system arranged to supply a required amount of air to engine combustion chambers through an intake air bypass passageway bypassing a throttle valve during engine warming-up.

2. Description of the Prior Art

In connection with a turbocharged internal combustion engine equipped with a turbocharger whose compressor wheel is disposed in an intake air passageway leading to engine combustion chambers, it is well known that air is fed to the engine combustion chambers through an intake air bypass passageway bypassing a throttle valve disposed in the intake air passageway downstream of the turbocharger compressor wheel during engine warming-up in which an air regulator disposed in the bypass passageway is opened. However, when the pressure prevailing in the intake passageway downstream of the throttle valve is higher than that in the intake passageway upstream of the compressor wheel, there arises a possibility that intake air reverse flow occurs toward the upstream side of the turbocharger compressor wheel through the bypass passageway, thereby lowering the supercharging efficiency of the turbocharger.

SUMMARY OF THE INVENTION

A turbocharged internal combustion engine according to the present invention comprises an intake air passageway communicable with an engine combustion chamber. A throttle valve is pivotally disposed within the intake air passageway. A turbocharger compressor wheel is disposed in the intake air passageway upstream of the throttle valve. An intake air bypass passageway is provided in a fashion to bypass the throttle valve and be communicable with the engine combustion chambers. An air regulator is disposed in the bypass passageway and arranged to allow air to flow into the engine combustion chambers through the bypass passageway during warming-up engine operation. Additionally, a check valve is disposed in the bypass passageway downstream of the air regulator to prevent intake air from its reverse flow in a direction from the intake air passageway downstream of the throttle valve toward the air regulator.

Consequently, by virtue of the check valve in the bypass passageway, intake air is prevented from its reverse flow toward the upstream side of the turbocharger compressor wheel even when the pressure prevailing in the intake air passageway downstream of the throttle valve becomes higher than that in the intake air passageway upstream of the turbocharger compressor wheel, thereby avoiding lowering in supercharging efficiency of the turbocharger while maintaining improved engine starting and accelerated engine warming-up.

BRIEF DESCRIPTION OF THE DRAWINGS

The features and advantages of the turbocharged internal combustion engine according to the present invention will be more clearly appreciated from the following description taken in conjunction with the accompanying drawings in which the same reference numerals designate the same parts and elements, in which.

DETAILED DESCRIPTION OF THE INVENTION

Figure 1:
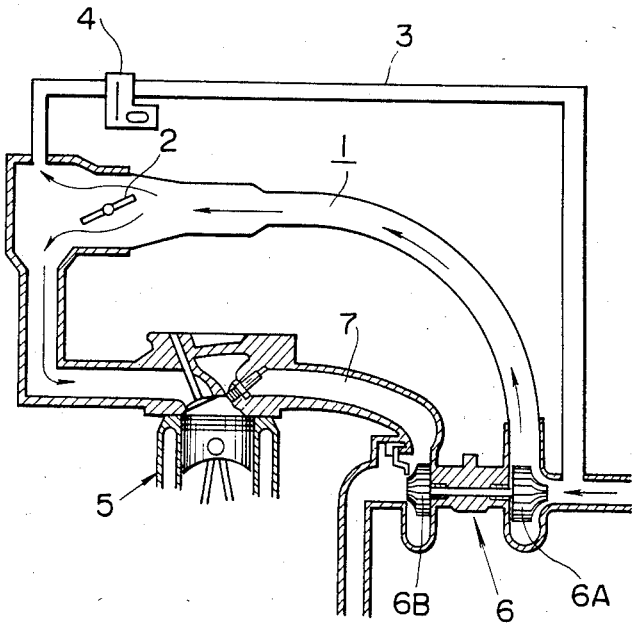
FIG.1 PRIOR ART
FIG. 1 is a schematic illustration of a conventional turbocharged internal combustion engine.

Referring to FIG. 1, a conventional turbocharged internal combustion engine equipped with an electronically controlled fuel injection system will be described along with its major shortcomings for the purpose of facilitating understanding of the present invention. In such an engine, during engine warming-up operation in which a throttle valve 2 disposed in an intake air passageway 1 is fully closed, an air regulator 4 allows air to flow through a bypass passageway 3 in order to supply air necessary for engine warming-up into engine combustion chambers (no numeral) of an engine proper 5.

More specifically, the air regulator 4 is constructed and arranged to be actuated in response, for example, to engine coolant temperature and to operate to allow air to flow through the bypass passageway 3 only when engine temperature is below a predetermined level, for example, at cold start. Thus, intake air is supplied through the bypass passageway 3 to the engine combustion chambers of the engine proper 5 under the action of the pressure differential between the upstream and downstream sides relative to the air regulator 4.

The compressor turbine 6A of a turbocharger 6 is rotatably disposed within the intake air passageway 1 upstream of the throttle valve 2, which turbocharger 6 is driven by exhaust gas pressure. The turbine wheel 6B of the turbocharger 6 is coaxially connected to the compressor turbine 6A and rotatably disposed within an exhaust gas passageway 7. Accordingly, intake air inducted through an air filter (no shown) is compressed by the turbocharger compressor wheel 6A and fed to the engine combustion chambers.

With such a turbocharged engine, the bypass passageway 3 is connected at its upstream end with intake air passageway 1 upstream of the compressor wheel 6A, thereby providing an advantage that air can be fed through the bypass passageway 3 to the engine combustion chambers without flow resistance during engine starting and engine warming-up.

However, when the pressure differential between the upstream and downstream sides relative to the air regulator 4 is reversed in which the pressure on the downstream side becomes higher than that on the upstream side, there arises a possibility that positive pressure intake air reversely flows through the air regulator and is restored to the intake air passageway 1 upstream of the compressor wheel, thereby sharply lowering supercharging efficiency.

Furthermore, during engine operation in which supercharging is being effected, so-called blow-by gas will reversely flow and impurities in the blow-by gas adhere to the turbocharger compressor wheel and an air flow meter (not shown) thereby to obstruct their operation.

Figure 2:
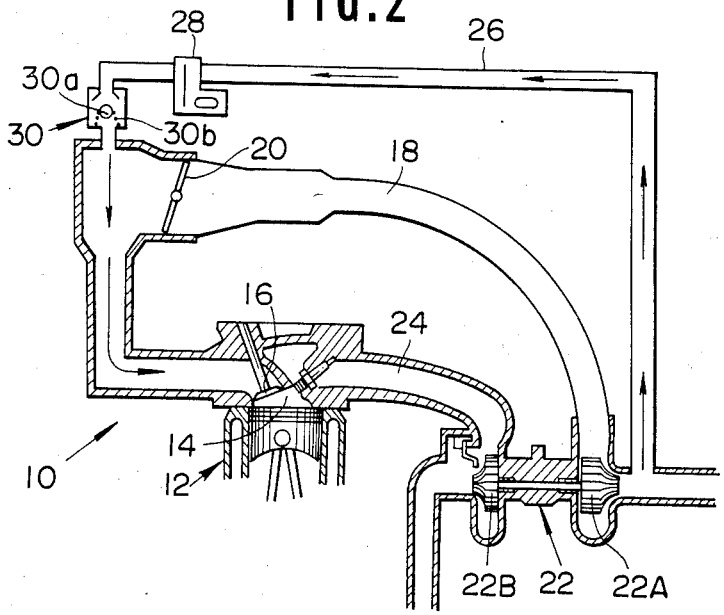
FIG. 2 is a schematic illustration of a preferred embodiment of a turbocharged internal combustion engine in accordance with the present invention, showing an engine operation mode.
Figure 3:
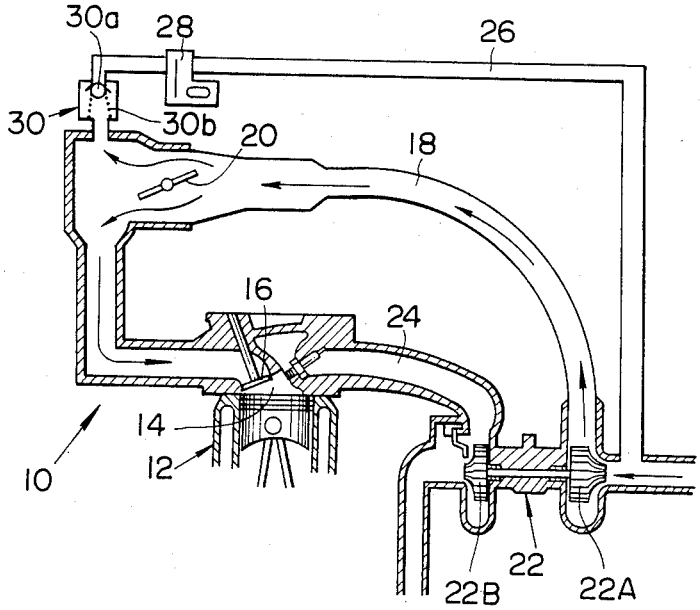
FIG. 3 is a schematic illustration similar to FIG. 2, but showing another engine operation mode.

In view of the above description of the conventional turbocharged engine, reference is now made to FIGS. 2 and 3, wherein a preferred embodiment of a supercharged internal combustion engine according to the present invention is illustrated by the reference numeral 10. The engine 10 comprises an engine proper 12 in which a combustion chamber or combustion chambers 14 are formed. In this instance, the combustion chamber 14 is supplied with fuel by means of an electronically controlled fuel injection system (not shown). An intake air passageway 18 is provided to establish communication between the engine combustion chamber 14 and atmospheric air so that one end of the intake air passageway 18 is directly communicable through an intake valve 16 with the combustion chamber 14 while the other end of the same is directly communicable through an air filter (not shown) with atmospheric air. A throttle valve 20 is pivotally disposed within the intake air passageway 18 to control intake air amount fed to the combustion chamber 14. Additionally, the compressor wheel 22A of a turbocharger 22 is rotatably disposed within the intake air passageway 18 downstream of the throttle valve 20. The turbine wheel 22B of the turbocharger 22 is coaxially connected to the compressor wheel 22A and rotatably disposed within an exhaust gas passageway 24 communicable with the combustion chamber 14 of the engine proper 12. Accordingly, intake air sucked through the air filter is compressed by the turbocharger compressor wheel 22A and fed to the combustion chamber 14.

An intake air bypass passageway 26 is provided to supply intake air into the intake air passageway 18 downstream of the throttle valve 20 in accordance with engine operating conditions. One end of the intake air bypass passageway 26 is connected to the intake air passageway 18 downstream of the throttle valve 20 while the other end of the same is connected to the intake air passageway 18 upstream of the turbocharger compressor wheel 22A. An air regulator 28 is disposed in the intake air bypass passageway 26, and arranged to be actuated in response, for example, to engine coolant temperature and to be opened to allow air to flow through the intake air bypass passageway 26, for example, during cold starting in which engine coolant temperature is lower. Disposed in the intake air bypass passageway 26 downstream of the air regulator 28 is a check valve or one-way valve 30 for allowing only air flow from the downstream side to the upstream side in the intake air bypass passageway 26. The check valve 30 in this instance includes a ball type valve member **30*a* and a spring 30*b* biasing the valve member, and arranged to operate as follows: when throttle valve 20 is closed so that vacuum is generated within the intake passageway 18 downstream of throttle valve 20, for example, during engine starting or warming-up engine operation, the valve member is pushed down to the side of the intake air passageway 18 against the bias of the spring 30*b* so as to establish a valve opening mode, thereby allowing air flow in the direction from the air regulator 28 to the intake air passageway 18 downstream of the throttle valve 20. When the throttle valve 20 is widely opened so that positive pressure is generated within the intake air passageway 18 downstream of the throttle valve 20 during an engine operation in which supercharging is being effected, the valve member 30*a* is biased to the side of the air regulator 28 by the bias of the spring 30*b* to establish a valve closing mode, thereby blocking the intake air bypass passageway 26**.

The manner of operation of the thus arranged engine will be discussed hereinafter.

During cold starting and warming-up operation of the engine in which the throttle valve 20 is controlled in a closed position, the air regulator 28 and the check valve 30 are both opened to allow air flow through the intake air bypass passageway 26 as shown in FIG. 2. Accordingly, air from the intake air passageway 18 upstream of the compressor wheel 22A is fed through the bypass passageway 26 into the combustion chamber 14 of the engine proper 12. At this time, since air is smoothly inducted into the combustion chamber 14 without flow resistance from the turbocharger compressor wheel 22A, engine starting is improved and engine warming-up is accelerated.

During normal engine operation in which supercharging is being effected in which the throttle valve 20 is controlled to be widely opened, intake air compressed by the turbocharger compressor wheel 22A is admitted through the throttle valve 20 to the intake air passageway 18 downstream of the throttle valve as shown in FIG. 3. At this time, since the pressure differential between the upstream and downstream sides in the intake air passageway 18 relative to the compressor wheel 22A, it appears during the opening of the air regulator 28, that intake air flows reversely from the intake air passageway 18 downstream of the throttle valve 20 into the intake air passageway 18 upstream of the compressor wheel 22A through the bypass passageway 26 which opens to the intake air passageway 18 downstream of the throttle valve 20.

However, in this embodiment, the check valve 30 is disposed within the bypass passageway 26 downstream of the air regulator 28, and therefore closure of the check valve is made by the above-mentioned pressure differential so as to prevent the reverse flow of the supercharged intake air to the intake air passageway 18 upstream of the compressor wheel 22A through the bypass passageway 26, thus avoiding lowering in supercharging efficiency of the turbocharger 22.

As is appreciated from the above, with the above-discussed turbocharged engine according to the present invention, air flow resistance of intake air is lowered during engine starting and warming-up, thereby improving engine starting and accelerating the engine warming-up. Additionally, by virtue of the check valve disposed in the intake air bypass passageway bypassing the throttle valve, intake air reverse flow is effectively prevented during normal engine operation in which supercharging is being effected, thus avoiding the efficiency lowering of the turbocharger.

What is claimed is:

1. A turbocharged internal combustion engine comprising:

means defining an intake air passageway communicable with an engine combustion chamber;

a throttle valve pivotally disposed in said intake air passageway;

a turbocharger having a compressor wheel rotatably disposed in said intake air passageway upstream of said throttle valve;

means defining an intake air bypass passageway connecting a first portion of said intake air passageway upstream of said compressor wheel with a second portion of said intake air passageway downstream of said throttle valve bypassing said throttle valve and said compressor and communicable with the engine combustion chamber;

an air regulator disposed in said intake air bypass passageway and arranged to allow air to flow from said intake air passageway upstream of said compressor wheel into the engine combustion chamber through said intake air bypass passageway only when engine temperature is below a predetermined level; and a check valve disposed in said intake air bypass passageway to prevent intake air from reverse flow in the direction from said second portion of said intake air passageway downstream of said throttle valve toward said air regulator.

2. A turbocharger internal combustion engine as claimed in claim 1 wherein said intake air passageway has a first end directly communicable with the engine combustion chamber, and a second end directly communicable with atmospheric air.

3. A turbocharged internal combustion engine as claimed in claim 1 wherein said check valve is constructed and arranged to block said intake air bypass passageway when the pressure prevailing in said intake air passageway downstream of said throttle valve is higher than that in said intake air passageway upstream of said turbocharger compressor wheel.

4. A turbocharged internal combustion engine as claimed in claim 3 wherein said check valve includes a ball type valve member, and a spring biasing said valve member in the direction to block said intake air bypass passageway.

5. A turbocharged internal combustion engine as claimed in claim 1 wherein said check valve is located downstream of said air regulator.

* * * * *